US006314863B1

(12) United States Patent
Kaneko

(10) Patent No.: US 6,314,863 B1
(45) Date of Patent: Nov. 13, 2001

(54) END-CLOSING STRUCTURE FOR AN ACTUATOR

(75) Inventor: Junya Kaneko, Abiko (JP)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/343,521

(22) Filed: Jun. 30, 1999

(30) Foreign Application Priority Data

Jul. 1, 1998 (JP) ..... 10-186620

(51) Int. Cl.[7] ..... F01B 29/00
(52) U.S. Cl. ..... 92/88
(58) Field of Search ..... 92/88, 164

(56) References Cited

U.S. PATENT DOCUMENTS 3,474,710 10/1969 Stryker .
4,211,150 7/1980 Framberg .
5,241,896 9/1993 Braun et al. .
5,507,218 4/1996 Lipinski .

FOREIGN PATENT DOCUMENTS 91 04 747 9/1992 (DE) .
43 34 424 4/1994 (DE) .
0 662 568 7/1995 (EP) .

*Primary Examiner*—Edward K. Look
*Assistant Examiner*—Michael Leslie
(74) *Attorney, Agent, or Firm*—Oblon, Spivak, McClelland, Maier & Neustadt, P.C.

(57) ABSTRACT

An end-closing structure for a rodless cylinder comprises an end cap and a sleeve. The end cap is fitted and inserted into a bore of a cylinder tube. Further, the sleeve is fitted and inserted into a through hole of the end cap through a hole of the cylinder tube. By means of inserting a spring pin into a hole through a hole, the bore is closed such that ends of the end cap and the cylinder tube are positioned substantially in the same plane surface.

7 Claims, 4 Drawing Sheets

END-CLOSING STRUCTURE FOR AN ACTUATOR

BACKGROUND OF THE INVENTION

1. Field of the Invention

The present invention relates to an end-closing structure for an actuator for transferring workpieces.

2. Description of the Related Art

In recent years, various types of actuators have been used as means for transferring workpieces in a factory or the like.

The actuators convert a power generated by air or oil pressure into a power for the use of mechanical work by a cylinder tube and a piston received into a cylinder chamber of the cylinder tube for being displaced axially along the cylinder chamber, wherein the cylinder tube and the piston are closely fitted together. One type of the above actuators is a rodded cylinder, wherein a piston rod is exposed from a rod cover connected to an end of the cylinder tube. Another type of the above actuators is a rodless cylinder, wherein the space needed for attaching the actuator is reduced.

For example, the above rodless cylinder is constructed such that a driving power can be taken out from a slit of the cylinder tube through a yoke or the like. The structure and the operation thereof will be briefly explained below.

A rodless cylinder shown in FIG. 3 includes a bore 2 extending longitudinally in a cylinder tube 1 of a cylinder body. Each end of the cylinder tube 1 is closed in an airtight manner by a cover 4 which serves to close the end of the cylinder tube 1 having a shape of a rectangular parallelopiped. A fluid input/output port 3a is defined in the cover 4. A cylindrical piston 5 is provided in the cylinder tube 1. Pressure receiving surfaces 5*a*, 5*b* are formed at both ends of the piston 5. A yoke 6 protruding from a slit (not shown) is provided on the upper portion of the piston 5. Further, a movable body 7, which engages with the yoke 6, is provided such that the movable body 7 is displaced in unison with the yoke 6. The slit of the cylinder tube 1 is covered with a seal band 8*a*, and the yoke 6 is covered with a dust seal band 8*b*.

In the rodless cylinder constructed as above, the piston 5 reciprocates along the bore 2 by, for example, pressurized fluid such as compressed air supplied from the fluid input/output port 3*a*. In this case, the yoke 6 and the movable body 7 are displaced in unison with the piston 5 such that a workplace (not shown) placed on the movable body 7 is transferred to a predetermined position.

The structure of closing the end of the rodless cylinder by the cover 4 will be further explained.

As shown in FIG. 4, the cover 4 comprises a rectangular parallelopiped member 4*a* and a cylindrical member 4*b*. The cylindrical member 4*b* has a step which extends into an unillustrated hole of the rectangular parallelopiped member 4*a*. Thus, the rectangular parallelopiped member 4*a* and the cylindrical member 4*b* are connected. The fluid input/output port 3*a* is defined in the center of an end surface of the rectangular parallelopiped member 4*a*. The fluid input/output port 3*a* communicates with a hole 3*c* of the cylindrical member 4*b* through a passage 3*b* defined in the rectangular parallelopiped member 4*a*. Further, through holes 4*c* are defined in the rectangular parallelopiped member 4*a* for attaching the rodless cylinder to another member. The cylindrical member 4*b* is inserted into the bore 2 defined in the cylinder tube 1 by four bolts 9 which are screwed into holes defined adjacent to four corners of the rectangular parallelopiped member 4*a*, respectively. In this way, the cover 4 is fixed to the end of the cylinder tube 1, thereby closing the bore 2.

The cover 4 of the conventional rodless cylinder (actuator) adopts a construction, wherein the rectangular parallelopiped member 4*a* and the cylindrical member 4*b* in different shapes are connected, and a plurality of bolts 9 are needed for fixing the cover 4 to the end of the cylinder tube 1. Accordingly, both of manufacturing and attaching operations thereof are laborious, and, the manufacturing cost of the actuator becomes rather high. Further, since the cover 4 is fixed to the cylinder tube 1 such that the cover 4 protrudes outwardly from the end of the cylinder tube 1, the overall longitudinal dimension of the apparatus is equal to a sum of dimensions of the cylinder tube 1 and the covers 4. Accordingly, an actuator as a finished product tends to be unduly elongated.

SUMMARY OF THE INVENTION

It is a general object of the present invention to provide an end-closing structure for an actuator which makes it possible to reduce the longitudinal dimension of the actuator so as to minimize the size thereof.

A major object of the present invention is to provide an end-closing structure for an actuator which makes it possible to simplify the assembling operation of an actuator to reduce the manufacturing cost thereof by providing a closing member for closing an end of an actuator body and an engaging member for fixing the closing member.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Preferred embodiment of an end-closing structure for an actuator according to the present invention will be explained in detail hereinbelow with reference to the accompanying drawings.

Figure 1:
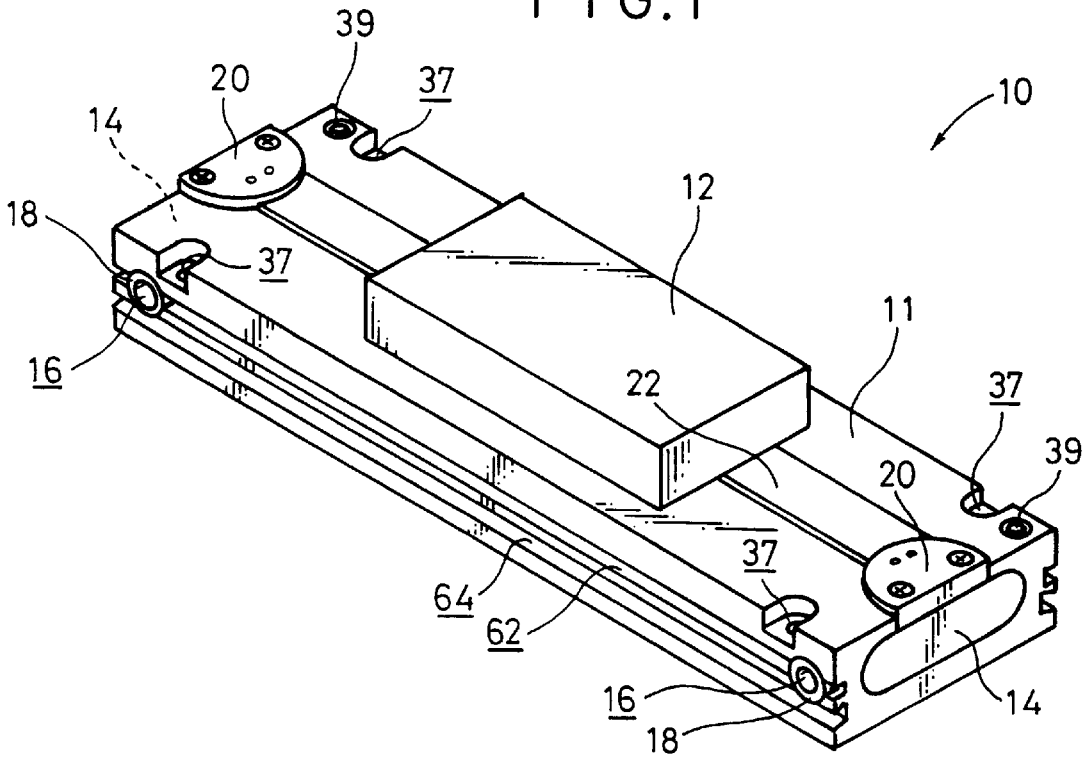
FIG. 1 is a schematic perspective view of a rodless cylinder, wherein the end-closing structure for an actuator according to the present embodiment is adopted.

A rodless cylinder 10 according to the end-closing structure for the actuator according to the present invention is shown in FIG. 1. With respect to the rodless cylinder 10, a bore (not shown) is defined in an elongated cylinder tube 11, and a piston (not shown) is provided in the bore. The piston is displaceable in unison with a movable body 12 provided on an upper surface of the cylinder tube 11 by a yoke (not shown) or the like.

An end of the cylinder tube 11 is closed by an end cap (closing member) 14. The end cap 14 is fixed by engagement to a sleeve (engaging member 18). A fluid input/output port 16 is defined at an end of the sleeve 18. The ends of the end cap 14 and the sleeve 18 are substantially in the same plane surface with the end of the cylinder tube 11. Further, a belt clamp 20 is provided on an upper part of the end cap 14. The belt clamp 20 supports a dust seal band 22 extending longitudinally on an upper part of the cylinder tube 11.

Figure 2:
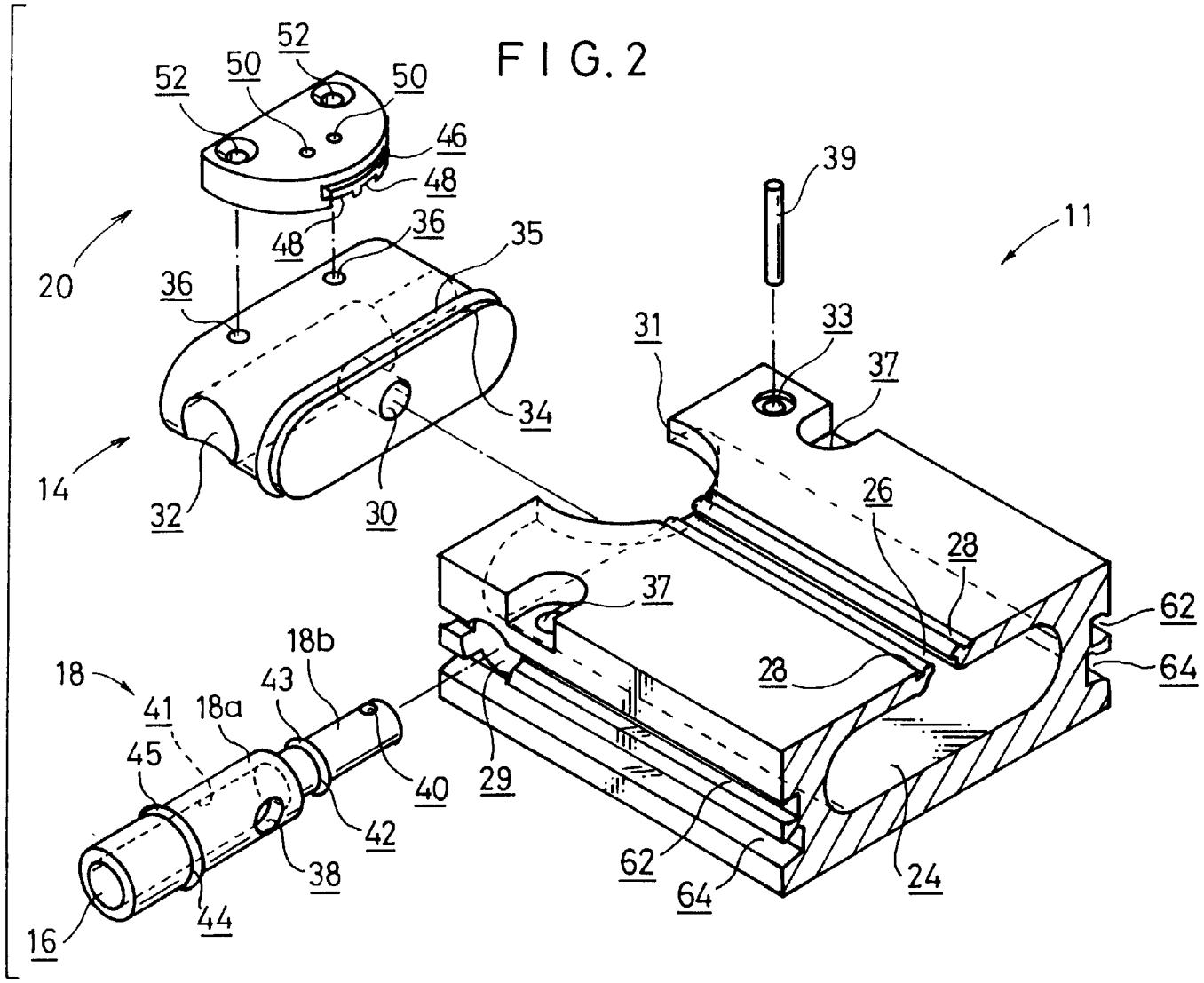
FIG. 2 is an exploded perspective view for an end portion of the rodless cylinder, wherein the end-closing structure for an actuator according to the present embodiment is adopted.
Figure 3:
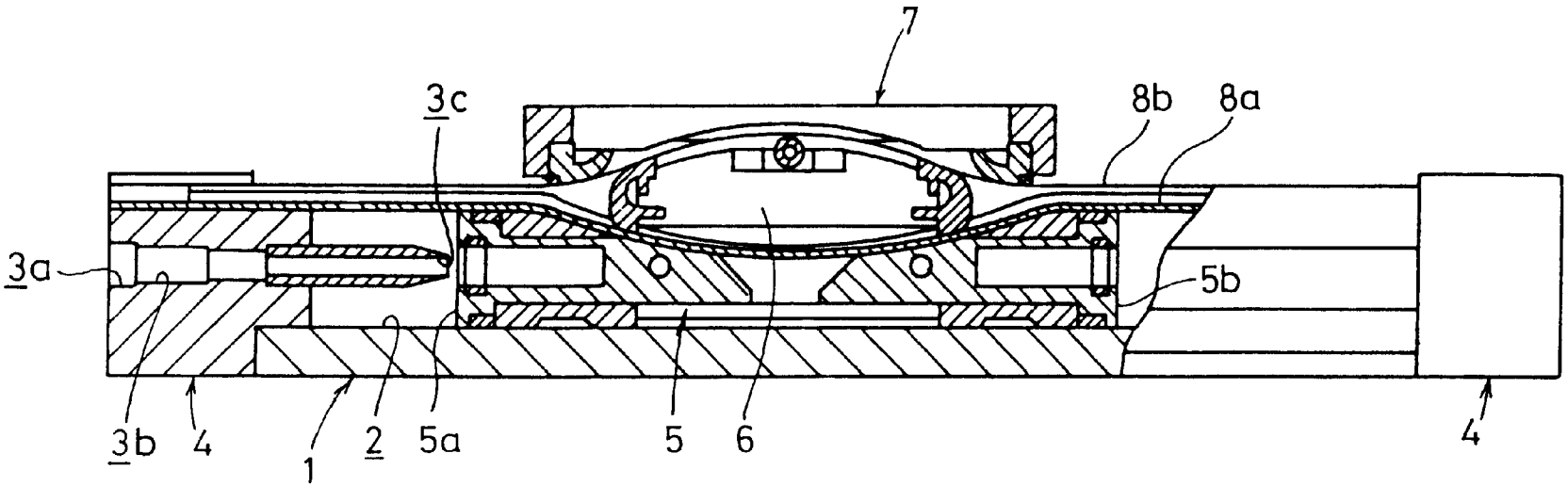
FIG. 3 PRIOR ART
FIG. 3 is a longitudinal cross sectional view, with partial cut out, illustrating a conventional rodless cylinder, wherein a cover for closing an end of a cylinder is attached.
Figure 4:
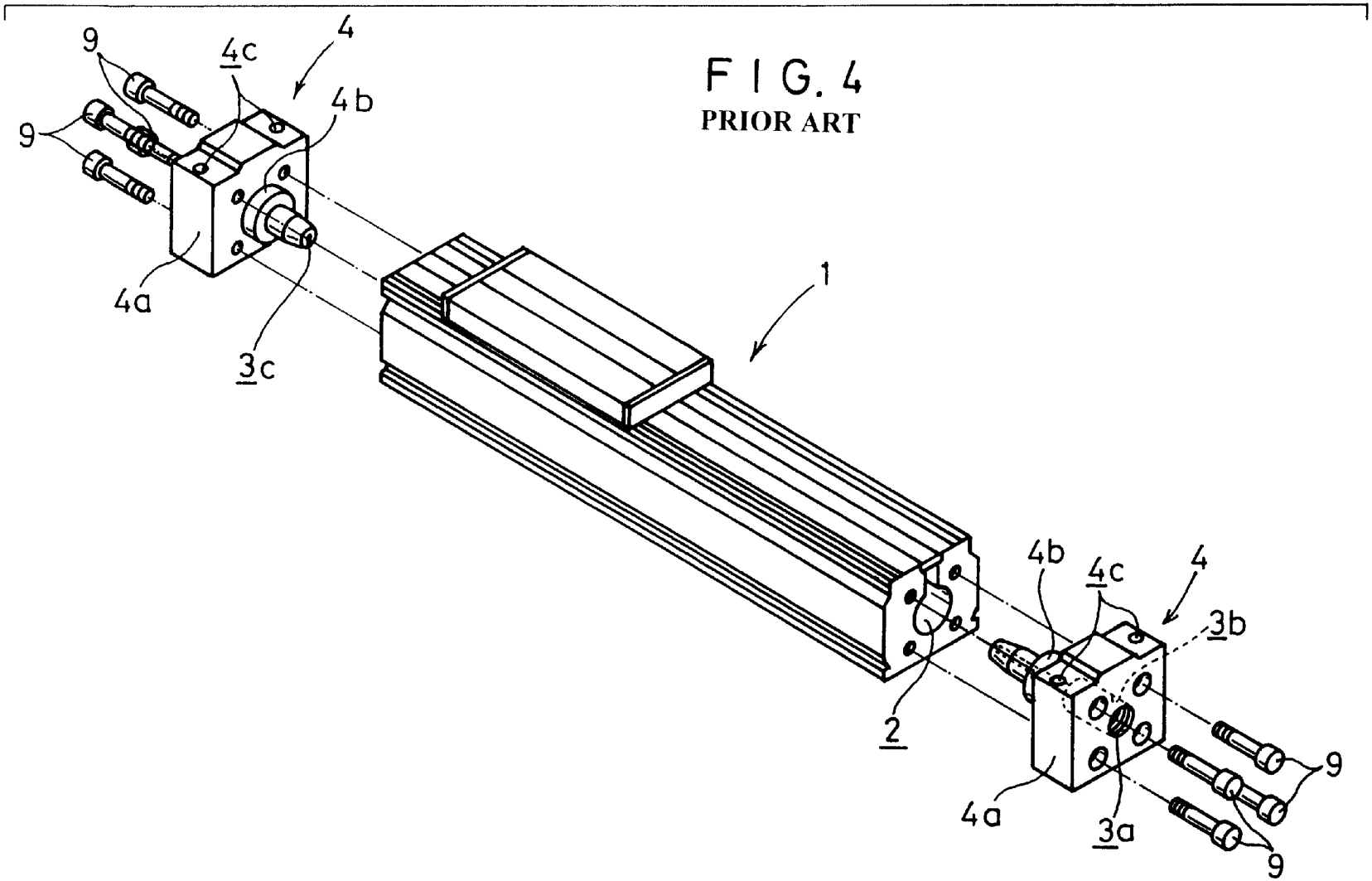
FIG. 4 PRIOR ART
FIG. 4 is a schematic exploded perspective view for illustrating the end-closing structure for a cylinder, wherein a cover according to the conventional rodless cylinder is used.

As shown in FIG. 2, the cylinder tube 11 has a bore (chamber) 24 extending longitudinally and having an elliptical cross section. The bore 24 communicates with the outside through a slit 26 defined on an upper surface of the cylinder tube 11. Recesses 28 are defined longitudinally on both sides sandwiching the slit 26 on the upper surface of the cylinder tube 11.

A hole 29 for inserting and fitting the sleeve 18 is defined at one side surface of the end of the cylinder tube 11. The hole 29 communicates with the bore 24. Further, a semicircular cut out 31 which communicates with the bore 24 and which has a shape corresponding to the belt clamp 20 is defined at the central end of the upper surface of the cylinder tube 11. A hole 33 having a step is defined perpendicularly to an axial direction of the hole 29 on a side opposite to the side at which the hole 29 is defined. Further, holes 37 are defined at both sides such that the cut out 31 is defined therebetween. A spring pin (pin member) 39 is provided to function as a rotation-prevention for the sleeve 18 by means of insertion into the hole 33. In this embodiment, since a plurality of conventional bolts for attaching a cover to the cylinder tube 11 are not required, a tap treatment on one side surface of the end of the cylinder tube 11 for making screw holes for inserting bolts thereinto becomes unnecessary. Accordingly, the manufacturing process thereof is simplified.

Next, the end cap 14 and the sleeve 18 or the like according to the closing structure of the present invention will be explained in detail hereinbelow.

The end cap 14 has an elliptically cylindrical outer configuration. A hole (a second hole) 30 for communication with the bore 24 is defined in the center of an elliptical surface of the end cap 14. A through hole (a first hole) 32 having a step is perpendicularly defined for communication with the hole 30. Further, a circumferential step 34 is formed around an outer circumferential edge on one end surface side where the hole 30 is defined. A seal member 35 having a shape of a ring is attached to the circumferential step 34. The seal member 35 functions for closing the end of the cylinder tube 11 in an airtight manner. On the other end surface side of the end cap 14, two holes 36 are defined. In this case, the outer configuration of the end cap 14 basically corresponds to the cross sectional configuration of the bore 24 of the cylinder tube 11. Therefore, the outer configuration of the end cap 14 should not be limited to have an elliptical cross section.

The sleeve 18 comprises a cylindrical member having a step. A hole (communicating hole) 38 having substantially the same diameter as that of the hole 30 is defined at a longitudinally central position of a cylindrical wall surface of the sleeve 18. The hole 38 extends in a direction perpendicularly to an axial direction of the sleeve 18 and communicates with the fluid input/output port 16 through a fluid passage 41. The fluid passage 41 ends at a portion 18*a*. The portion 18*a* is closed by a solid portion 18*b*. The sleeve 18 may be constructed to define a through hole extending along an axial direction of the sleeve 18 such that one end of the through hole functions as the fluid input/output port 16 and the other end thereof is closed by an unillustrated cover plug. A hole 40 opening upwardly is defined at the solid portion 18*b*. A circulating groove 42 is defined at a position spaced from the hole 40 of the solid portion 18*b*. A ring-shaped seal member 43 is attached to the circulating groove 42. Further, a ring-shaped seal member 45 is attached through a circulating groove 44 to a position axially spaced by a predetermined distance from the seal member 43. These seal members 43 and 45 are used for sealing a fluid passage defined between the fluid input/output port 16 and the hole 30 from outside in an airtight manner by means of insertion of the sleeve 18 into the through hole 32 of the end cap 14. Due to the annular step formed between the portion 18*a* and the solid portion 18*b* of the sleeve 18, insertion of the sleeve 18 into the through hole 32 of the end cap 14 becomes easier. Further, the seal member 43 can be prevented from being detached at the time of insertion of the sleeve 18.

Further, the belt clamp 20 to be placed on an upper side of the end cap 14 comprises a thin-walled member in a semicircular shape. A hole 46 having a rectangular cross section and two stripes of grooves 48 are defined at the top portion of the circumferential side surface of the belt clamp 20. The grooves 48 opening downwardly are defined with an intermediary wall portion lying therebetween. Two holes 50 communicating with the grooves 48 through the hole 46, and two through holes 52 for attachment are defined in the belt clamp 20, respectively.

Further, as shown in FIGS. 1 and 2, at both opposite sides of cylinder tube 11, two stripes of grooves 62, 64 for attaching sensors are defined to extend substantially in parallel with each other along an axial direction. A sensor for detecting the position of a piston (not shown) is fastened to each of the grooves 62, 64 for attaching a sensor.

Next, with respect to the end-closing structure for the actuator according to the present invention, a method for attaching each member to the cylinder tube 11 will be explained below.

Firstly, the end cap 14 to which the seal member 35 is attached is inserted into the bore 24 of the cylinder tube 11, directing a side on which the hole 30 is defined. In this case, the end cap 14 is received completely in the cylinder tube 11 such that the end of the end cap 14 and the end of the cylinder tube 11 are positioned substantially in the same plane surface (see FIG. 1).

Next, the sleeve 18 to which the seal members 43 and 45 are attached is inserted through a hole 29 of the cylinder tube 11 and into the through hole 32 of the end cap 14, directing a side of the solid portion 18*b* to the hole 29. In this case, the sleeve 18 is received in the cylinder tube 11 completely such that the end of the sleeve 18 and a side surface of the cylinder tube 11 are positioned substantially in the same plane surface (see FIG. 1).

In this way, the end cap 14, the sleeve 18 and the cylinder tube 11 are fitted together. In this case, the bore 24 of the cylinder tube 11 is sealed in an airtight manner by the three seal members 35, 43 and 45.

Next, a spring pin 39 is inserted into the hole 33 of the cylinder tube 11 and then into the hole 40 of the sleeve 18. In this way, the cylinder tube 11, sleeve 18 and the end cap 14 are engaged together.

In this case, the spring pin 39 not only reliably makes the sleeve 18 engage with the cylinder tube 11 but also functions as a rotation-prevention to prevent the sleeve 18 from rotating. As a means of ensuring the latter function, instead of the spring pin 39, for example, an engaging member (not shown) such as a screw may be provided. Alternatively, the cross sectional shape of the sleeve 18 and the hole 29 corresponding thereto may be polygonal. Further, the spring pin 39 also functions for preventing the sleeve 18 from being detached from the cylinder tube 11.

In attaching the cylinder tube 11 to the movable body 12, the belt clamp 20 is positioned at the cut out portion 31. The end of seal belt (not shown) for sealing the slit 26 of the cylinder tube 11, which was already explained as the conventional technique, is inserted into the grooves 48 of the belt clamp 20. Also, the end of the dust seal band 22 is inserted into the hole 46 of the belt clamp 20. Then, a screw member (not shown) is inserted through the hole 50 of the belt clamp 20 for fastening. Accordingly, each end of the seal belt and the dust seal band 22 is fixed by engagement by the belt clamp 20. Further, screw members (not shown) are screwed into the attachment holes 52 of the belt clamp 20 and then into the holes 36 of the end cap 14, respectively. Thus, the belt clamp 20 is fixed to the end cap 14.

As described above, the end cap 14 and the sleeve 18 constituting the end-closing structure for the actuator according to the present embodiment are fitted and inserted into the cylinder tube 11 such that they are basically assembled together. Further, the reliable engagement of these members and the rotation-prevention of the sleeve 18 can be achieved by only a single spring pin 39. Accordingly, attaching and disassembling operations for the end-closing structure are simply performed in a short time. Further, since the end-closing structure for the actuator is constituted by a few members having relatively simple configurations, it can be manufactured at a reduced cost with a single material in line with, so called, "the inverse manufacturing system". Further, main members according to the end-closing structure do not require the fixing bolts 9 of the cover 4 unlike the embodiment of the conventional technique. In the present embodiment, since the attachment holes 37 of the cylinder tube 11 are used to substitute for the conventional holes 4*c* for attaching a main body, spaces for receiving bolts are not required. Accordingly, whole length of the end cap 14 itself is reduced. Further, since the end cap 14 is received in the cylinder tube 11 substantially completely, the longitudinal dimension of the rodless cylinder 10 can be reduced. Furthermore, since the longitudinal dimension along the bore 24 of the end-closing structure received in the cylinder tube 11 is small, a movable range of the piston in the bore 24 is not reduced in comparison with the conventional technique.

In using the rodless cylinder 10, a fluid pressure-supplying source for air or the like is connected to communicate with the fluid input/output port 16 of the sleeve 18. Under the fluid pressure, as explained in the embodiment of the conventional technique, by pressing the first or the second pressure-receiving surface of the piston, movable body is displaced in unison with the piston.

The end-closing structure for the actuator according to the present embodiment should not be limited for the use of a rodless cylinder. Rather, it can be used for the most actuators including the rodless cylinder. Further, it is used, for example, in the case for closing an end of a pressure container in an airtight manner or in a liquid-tight manner.

As explained above, according to the end-closing structure of the present invention, manufacturing processes and attaching operations of respective members for constructing the closing structure are simplified. Accordingly, manufacturing cost of an actuator can be reduced. Further, the size of the actuator can be minimized by reducing the longitudinal dimension thereof.

According to the end-closing structure for an actuator of the present invention, manufacturing processes and attaching operations of an end cap and a sleeve are easy. Further, manufacturing cost of a rodless cylinder can be reduced and respective members can be fabricated with a single material.

Further, according to the end-closing structure of the present invention, the size of an actuator can be minimized by reducing the vertical dimension thereof.

What is claimed is:

1. An end-closing structure for an actuator having an actuator body in which a chamber is defined and a piston which is displaceable under an operation of pressurized fluid supplied to said chamber, said structure comprising:

a closing member which is fitted and inserted into an opening defined at an end of said actuator body for closing said opening;

an engaging member which engages to fix said closing member to said actuator body such that said end of said actuator body and an end of said closing member are positioned substantially in the same plane surface, said engaging member having a fluid input/output port defined therein for communication with said chamber through a fluid passage; and rotation-preventing means for preventing said engaging member from rotating with respect to said closing member, wherein said rotation-preventing means comprises a pin member which passes through said engaging member in a substantially perpendicular direction to an axial direction of said engaging member, said pin member being fixed by engagement with a hole defined in said actuator body so as to prevent said engaging member from rotating.

2. An end-closing structure for an actuator according to claim 1, wherein said actuator comprises a rodless cylinder, said closing member comprising an end cap for closing an opening defined at an end of a cylinder tube, and said engaging member comprising a sleeve for fixing said end cap by engagement to said cylinder tube, a hole is defined in said end cap for insertion of said sleeve, and a fluid passage is defined in said sleeve for communication between said fluid input/output port and said chamber.

3. An end-closing structure for an actuator according to claim 2, wherein said hole defined in said cylinder tube is positioned to be offset in a substantially perpendicular direction to an axial direction of said cylinder tube, said pin member being inserted into a hole defined in a solid portion of said sleeve, thereby preventing said sleeve from rotating.

4. An end-closing structure for an actuator according to claim 3, wherein said hole defined in said cylinder tube is positioned between a side of said cylinder tube at which grooves for attaching sensors are defined and said chamber defined in said cylinder tube.

5. An end-closing structure for an actuator according to claim 2, wherein a first hole into which said sleeve is inserted and a second hole which communicates with said chamber are defined in said end cap, and a communication hole is defined in said sleeve for communication between said second hole of said end cap and said fluid input/output port.

6. An end-closing structure for an actuator according to claim 2, wherein said closing member is formed to have a oval-shape in cross section corresponding to said opening of said chamber.

7. An end-closing structure for an actuator having an actuator body in which a chamber is defined and a piston which is displaceable under an operation of pressurized fluid supplied to said chamber, said structure comprising:

a closing member which is fitted and inserted into an opening defined at an end of said actuator body for closing said opening; and an engaging member which engages to fix said closing member to said actuator body such that said end of said actuator body and an end of said closing member are positioned substantially in the same plane surface, said engaging member having a fluid input/output port defined therein for communication with said chamber through a fluid passage, wherein said actuator comprises a rodless cylinder, said closing member comprising an end cap for closing an opening defined at an end of a cylinder tube, and said engaging member comprising a sleeve for fixing said end cap by engagement to said cylinder tube, a hole is defined in said end cap for insertion of said sleeve, and a fluid passage is defined in said sleeve for communication between said fluid input/output port and said chamber, and wherein said sleeve is formed to have a cylindrical configuration having an annular step in an intermediary section along longitudinal direction thereof, said hole in which said sleeve is inserted has a shape corresponding to the shape of said sleeve.

* * * * *